US010352029B1

(12) United States Patent
Tong

(10) Patent No.: US 10,352,029 B1
(45) Date of Patent: Jul. 16, 2019

(54) ROTATABLE TOILET TANK LEVER

(71) Applicant: Kun Yuan Tong, Suwanee, GA (US)

(72) Inventor: Kun Yuan Tong, Suwanee, GA (US)

( * ) Notice: Subject to any disclaimer, the term of this patent is extended or adjusted under 35 U.S.C. 154(b) by 0 days.

(21) Appl. No.: 16/130,679

(22) Filed: Sep. 13, 2018

(51) Int. Cl.
*E03D 5/092* (2006.01)
*E03D 3/12* (2006.01)

(52) U.S. Cl.
CPC ..... *E03D 5/092* (2013.01); *E03D 3/12* (2013.01)

(58) Field of Classification Search
CPC .. E03D 3/12; E03D 5/09; E03D 5/092; E03D 5/094
USPC ..... 4/405, 411, 412, 413, 415
See application file for complete search history.

(56) References Cited

U.S. PATENT DOCUMENTS 2,543,438 A * 2/1951 Cochran ..... E03D 1/34 4/411
3,122,756 A * 3/1964 Bradley ..... F16K 1/523 251/285
3,278,948 A * 10/1966 William ..... E03D 5/02 4/405
3,358,294 A * 12/1967 Nolan ..... E03D 5/026 251/89
3,719,957 A * 3/1973 Riedel ..... E03D 1/34 4/324
3,745,591 A * 7/1973 Girten ..... E03D 1/142 4/324
4,356,576 A * 11/1982 Gala ..... E03D 5/09 4/324
5,117,513 A * 6/1992 Burrowes ..... E03D 1/14 4/324
5,708,990 A * 1/1998 Mucciarone ..... E03D 1/14 4/324
6,385,786 B1 * 5/2002 Lester ..... E03D 1/14 4/325
6,421,844 B1 * 7/2002 Scott ..... E03D 1/14 4/325
9,447,570 B1 * 9/2016 Schuster ..... E03D 5/094
10,156,063 B2 * 12/2018 Barish ..... E03D 5/09
2010/0058526 A1 * 3/2010 Tong ..... E03D 1/14 4/415
2010/0257666 A1 * 10/2010 Tong ..... E03D 1/14 4/324
2017/0350439 A1 * 12/2017 Fuduloff ..... F16B 39/06

* cited by examiner

*Primary Examiner* — Janie M Loeppke
(74) *Attorney, Agent, or Firm* — Wang Law Firm, Inc.

(57) ABSTRACT

A rotatable toilet tank lever equipped with a stopper has a controller to limit its upward movement. When engaged, the upward movement of the controller is stopped by an adjustment stick hitting the cover of toilet water tank. Therefore, the upward movement of the flapper inside the toilet tank is also limited and the amount of water, about half a gallon, draining into the toilet suffices to flush liquid human waste. When the intervention of the controller is eliminated by turning the handle of the rotatable toilet tank lever with controller clockwise 90 degrees to 180 degrees then the flapper can be lifted all the way up to float in the toilet water tank to allow the whole tank of water, about two gallons, to drain into the toilet bowl to flush solid human waste.

9 Claims, 7 Drawing Sheets

ROTATABLE TOILET TANK LEVER

FIELD OF THE INVENTION

The present invention relates to plumbing and more specifically to a toilet component.

BACKGROUND OF THE INVENTION

An ordinary toilet tank lever is designed to deliver whole tank of water, about two (2) gallons per flush and new toilet tanks are designed to use less amount of water. Most of the water saving mechanisms involves additional mechanisms installed inside the toilet tank. So, unless a homeowner replaces the entire toilet, he cannot easily save water usage. Therefore, a simpler device that enables reduction of water use is needed.

BRIEF SUMMARY OF THE INVENTION

In one embodiment, the present invention is a rotatable toilet lever for assembling to a toilet tank comprises a body, a linkage mechanism connected to the body, a limiting mechanism connected to the body, and an activation mechanism, wherein, when the rotatable toilet lever is assembled onto the toilet tank, movement of the linkage mechanism is limited by the limiting mechanism.

In alternative embodiment, the present invention is a rotatable toilet lever comprises a body, a lifting arm attached to the body, a pivot attached to the body, a controller connected to the pivot, a push handle connected to the pivot, and a stopper movably connected to the controller.

The rotatable toilet lever of the present invention enables a user to convert an existing toilet tank into a water saving toilet and for each flush the user can switch between a full flush or a reduced water flush with a simple adjustment of the rotatable toilet lever.

DETAILED DESCRIPTION OF THE INVENTION

A rotatable toilet tank lever according to the present invention is a simple device that enables a home owner to easily limit the amount of water used in a traditional toilet tank to without replacing the toilet tank. The rotatable toilet tank lever has a body, a limiting mechanism, an activation mechanism, and a linkage mechanism. The linkage mechanism connects to a flapper lifting device, usually a chain.

The limiting mechanism limits the movement of the linkage mechanism and the activation mechanism enables the user to activate the rotatable toilet tank lever.

Figure 1:
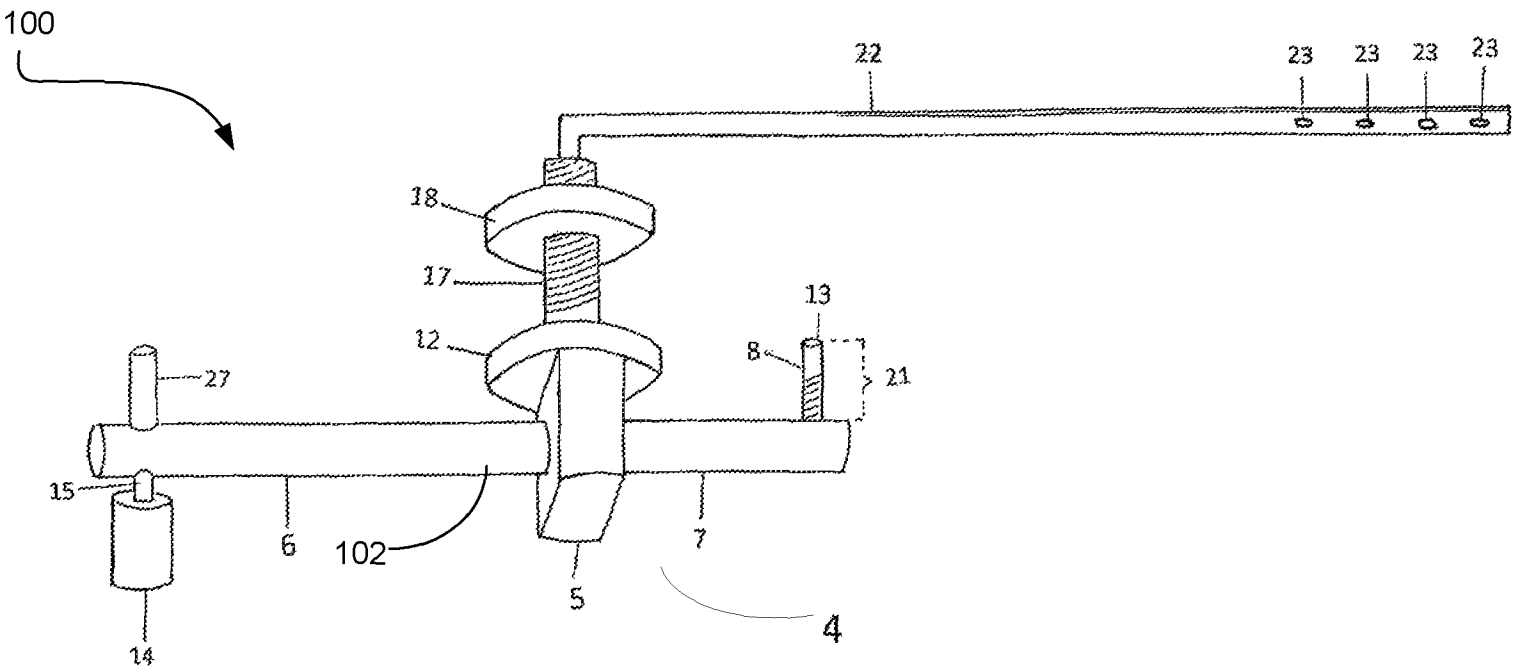
FIG. 1 is an illustration of an assembled rotatable toilet tank lever equipped with an L-shaped stopper.

FIG. 1 is an illustration 100 of a rotatable toilet tank handle 4 according to one embodiment of the present invention. The rotatable toilet tank handle 4 comprises a lifting arm 22 attached to a threaded axle 17, which is part of a toilet handle 4. The lifting arm 22 forms the linkage mechanism. The lifting arm 22 has a plurality of through holes 23 for hanging lifting chains (not shown). The lifting chain is attached to a flapper that controls the flow of water into the toilet bowl. The body of the rotatable toilet lever is formed by a pivot 5 connected to a circular plate 12 and the threaded axle 17 is connected to the circular plate 12. The rotatable toilet tank handle 4 is fixed on a toilet tank by fitting the lifting arm and the threaded axle 17 through a hole in the toilet tank and securing the circular plate 12 on the toilet tank by placing a nut 18 onto the threaded axle 17 and tightening the nut 18 against the toilet tank wall. The nut 18 has a center hole 19.

Figure 2:
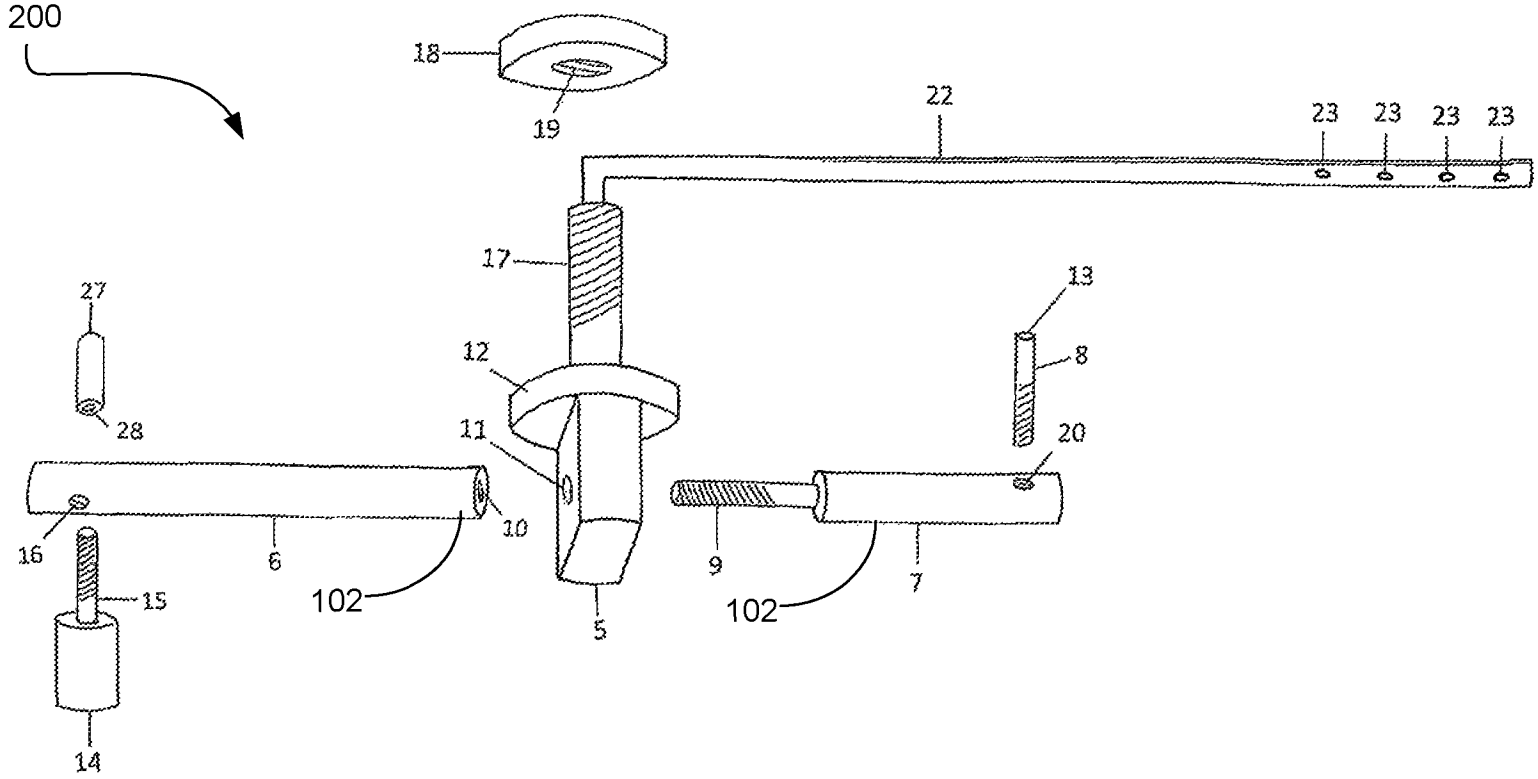
FIG. 2 is an illustration of the components of the rotatable toilet tank lever equipped with the L-shaped stopper.

The pivot 5 on the rotatable toilet handle has a through hole 11 shown in FIG. 2 and a lever 102 is connected to the rotatable toilet handle. The lever is made from two parts: a controller 7 and a push handle 6. The push handle 6 further has a thumb screw 14 with a threaded pin 15 secured by a top pin 27. An adjustment stick 8 is connected to the controller 7 and the adjustment stick 8 serves as a stopper for limiting the upward movement of the controller. The adjustment stick 8 is threaded and can adjust the high 21 of the tip 13 by rotating the adjustment stick 8 into or out of the controller 7. The controller 7 and the adjustment stick 8 form the limiting mechanism and the adjustment stick 8 moves relative to the controller 7. The push handle 6 and the thumb screw 14 form the activation mechanism and the thumb screw 14 enables the push handle 6 to rotate relative to the axis of the push handle 6. Besides enabling the lifting arm 22 to move upwardly and allowing the water to flow into a toilet bowl, the activation mechanism also enables the limiting mechanism by moving the position of the adjustment stick 8.

In an alternative embodiment, the thumb screw 14, the threaded pin 15, and the top pin 27 may not be needed for the activation mechanism. Yet in another alternative embodiment, the controller 7 and the push handle 6 may form one single body attached to or passing through the pivot 5.

FIG. 2 is an illustration 200 of a disassembled rotatable toilet tank lever. As it is shown, the lever 102 is assembled from the controller 7 and the push handle 6. The controller 7 has a narrow threaded rod 9 and the narrow threaded rod 9 can fit through the through hole 11 on the pivot 5. The push handle 6 has a threaded hole 10 for receiving the narrow threaded rod 9. The adjustment stick 8 is inserted into the threaded hole 20 on the controller 7. There is a threaded through hole 16 on the push handle 6 and the threaded pin 15 is pushed through the through hole 16 and the top pin 27 has a threaded hole 28 for receiving the threaded pin 15. The top pin 27 is an optional and the thumb screw 14 and the threaded pin 15 can be attached directly onto the push handle 26 without the top pin 27.

Figure 8:
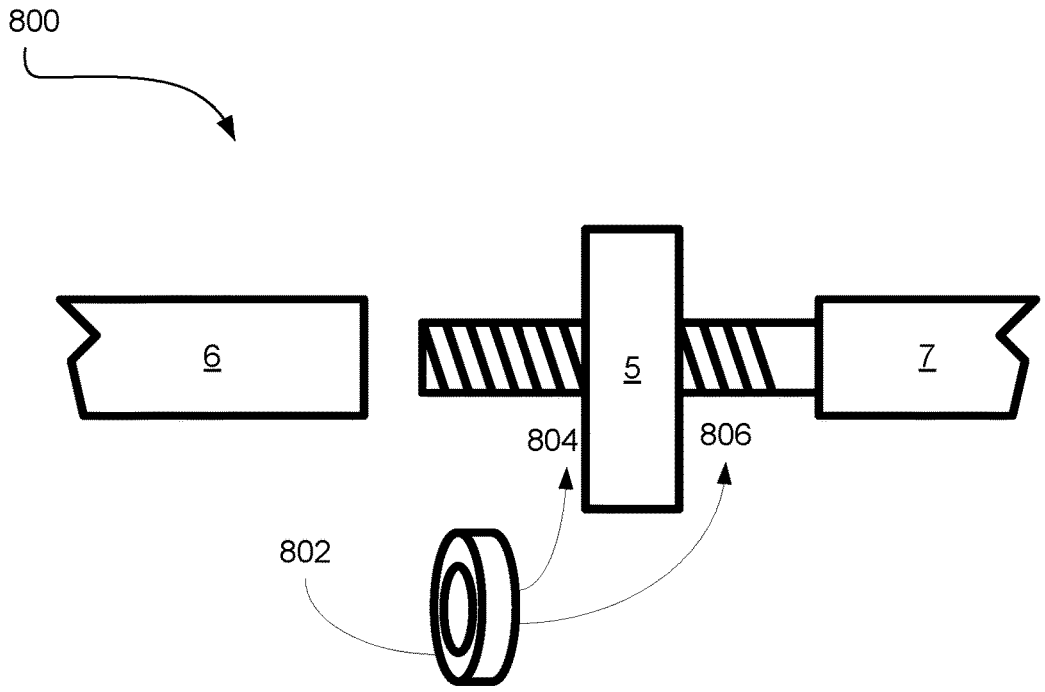
FIG. 8 depicts an alternative embodiment to adjust the length of the controller and the push handle.

Each of the controller 7 and the push handle 6 has a fixed length as shown in FIG. 1; however, in an alternative embodiment, the lengths of the controller 7 and the push handle 6 relative to the pivot 5 can be adjusted through use of spacer ring 802 as shown in illustration 800 of FIG. 8. One or more spacer rings 802 can be inserted onto and on either side (positions 804 or 806) of the narrow threaded rod 9. The use of the spacer rings 802 at the position 806 lengthens the controller 7 and has an effect that further limits the upward movement of the adjustment stick 8. The insertion of the spacer rings 802 at the position 804 lengthens the push handle 6, thus making easier for elderly people to push down the push handle 6.

Figure 3:
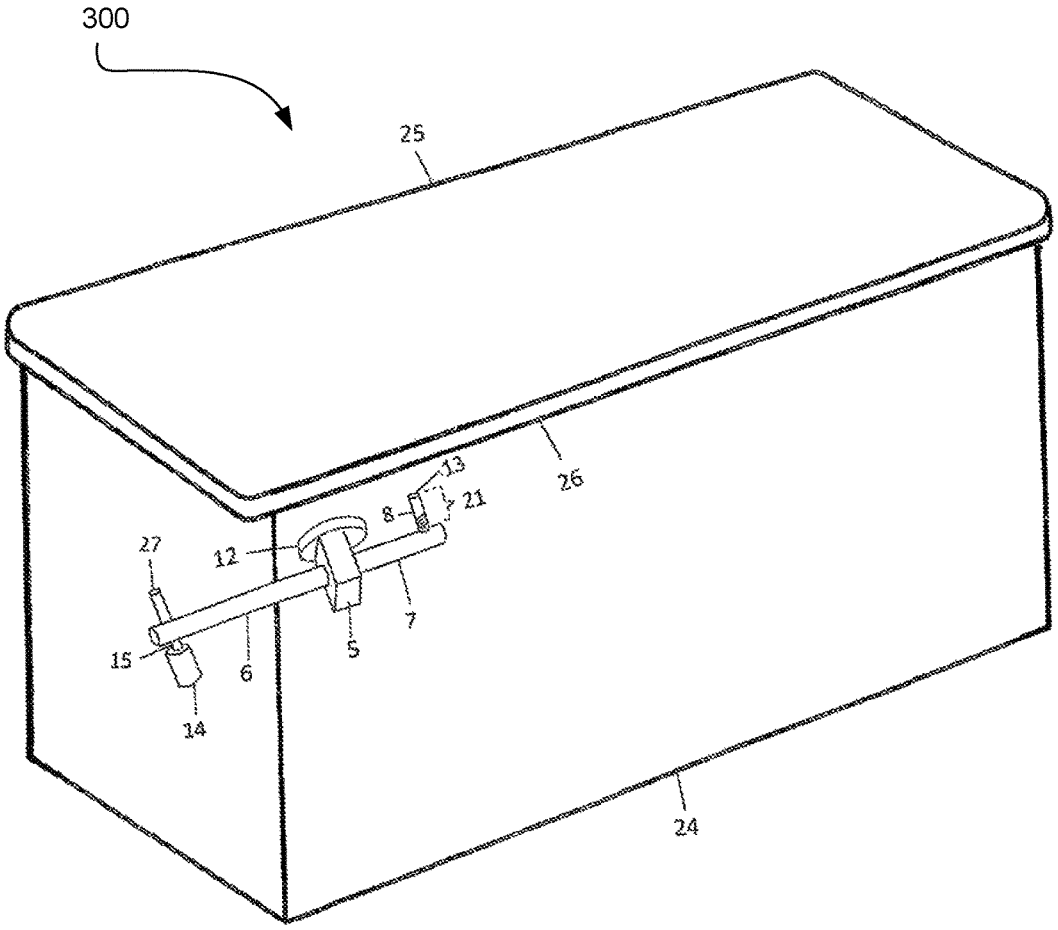
FIG. 3 depicts the rotatable toilet tank lever assembled onto a toilet tank.
Figure 7:
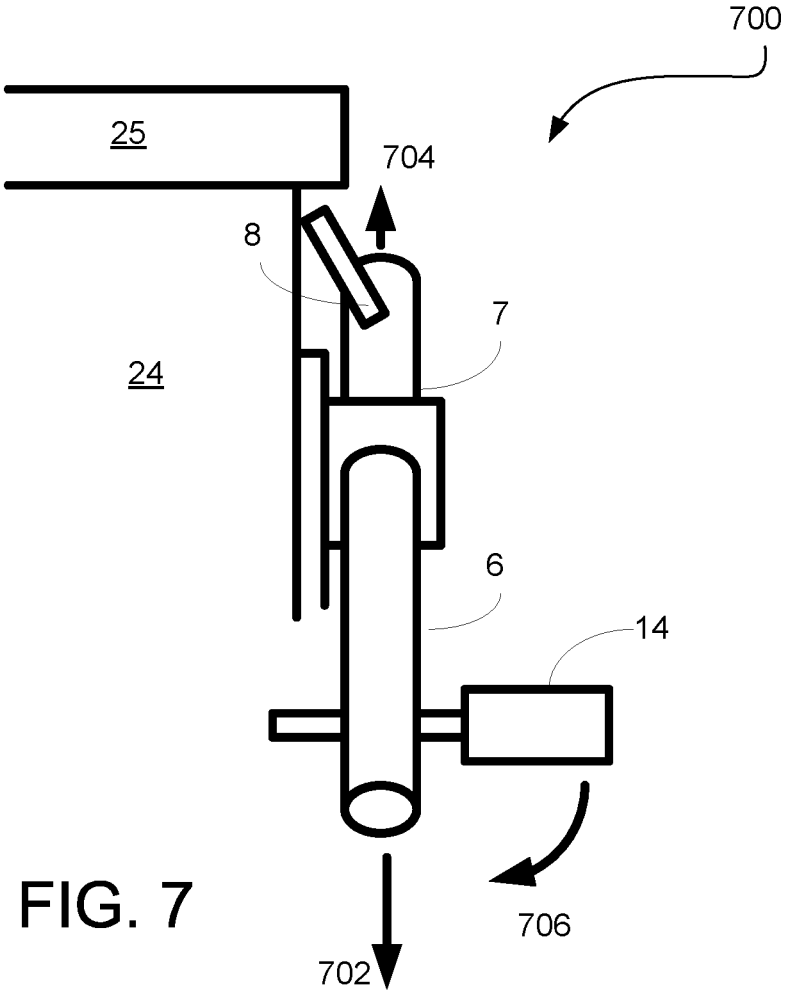
FIG. 7 depicts the rotatable toilet tank lever in an engaged state.

FIG. 3 is an illustration 300 of a rotatable toilet tank lever assembled on a toilet tank 24 with a cover 25. FIG. 7 is a simplified drawing 700 showing the operation of the rotatable toilet tank lever. When the rotatable toilet lever is in the engaged position with the adjustment stick 8 pointed upward and the push handle 6 is pushed down 702, the controller 7 moves upwardly 704. However, the upward movement of the controller 7 is limited by the adjustment stick 8. The adjustment stick 8 hits the cover 25 of the toilet tank 24 and thus limiting the upward movement of the controller 7. Consequently the upward movement of the lifting arm 22 is also limited and the amount of water flowing into the toilet is thus reduced. If the reduction of the water flow is not desired, the rotatable toilet tank lever can be placed in a disengaged position by rotating the thumb screw 14 downwardly 706, which will cause the adjustment stick 8 to rotate away from the tank 24, thus preventing contact with the cover 25. Rotating 90 or 180 degrees causes the thumb screw 14 to move between the engaged position and the disengaged position.

Figure 4:
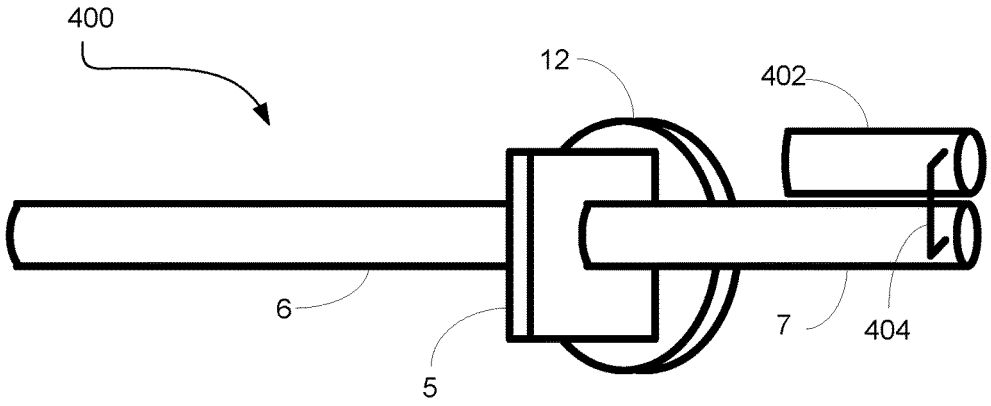
FIG. 4 depicts an rotatable toilet tank lever according to an alternative embodiment.
Figure 5:
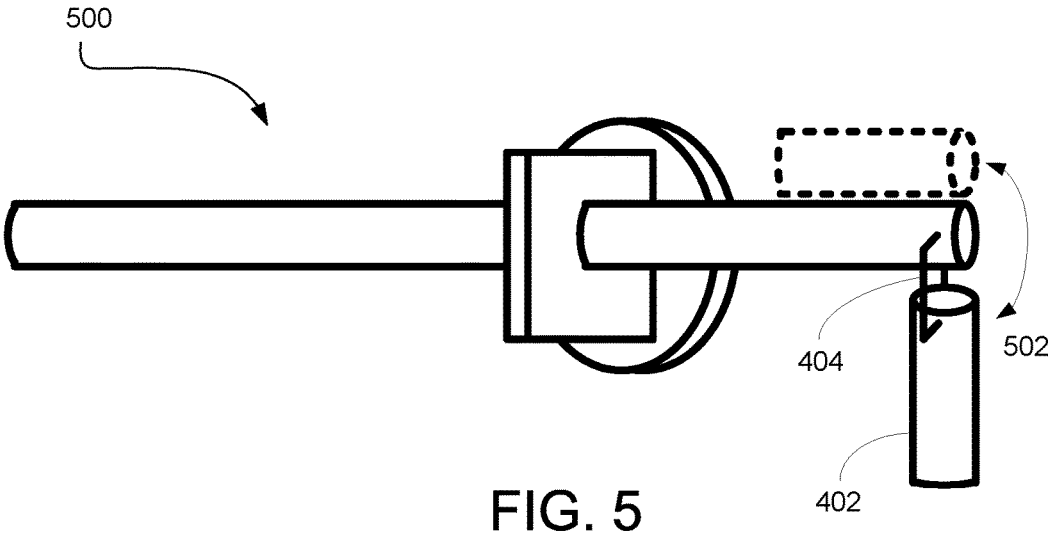
FIG. 5 depicts the rotatable toilet tank lever of FIG. 4 in an disengaged position.
Figure 6:
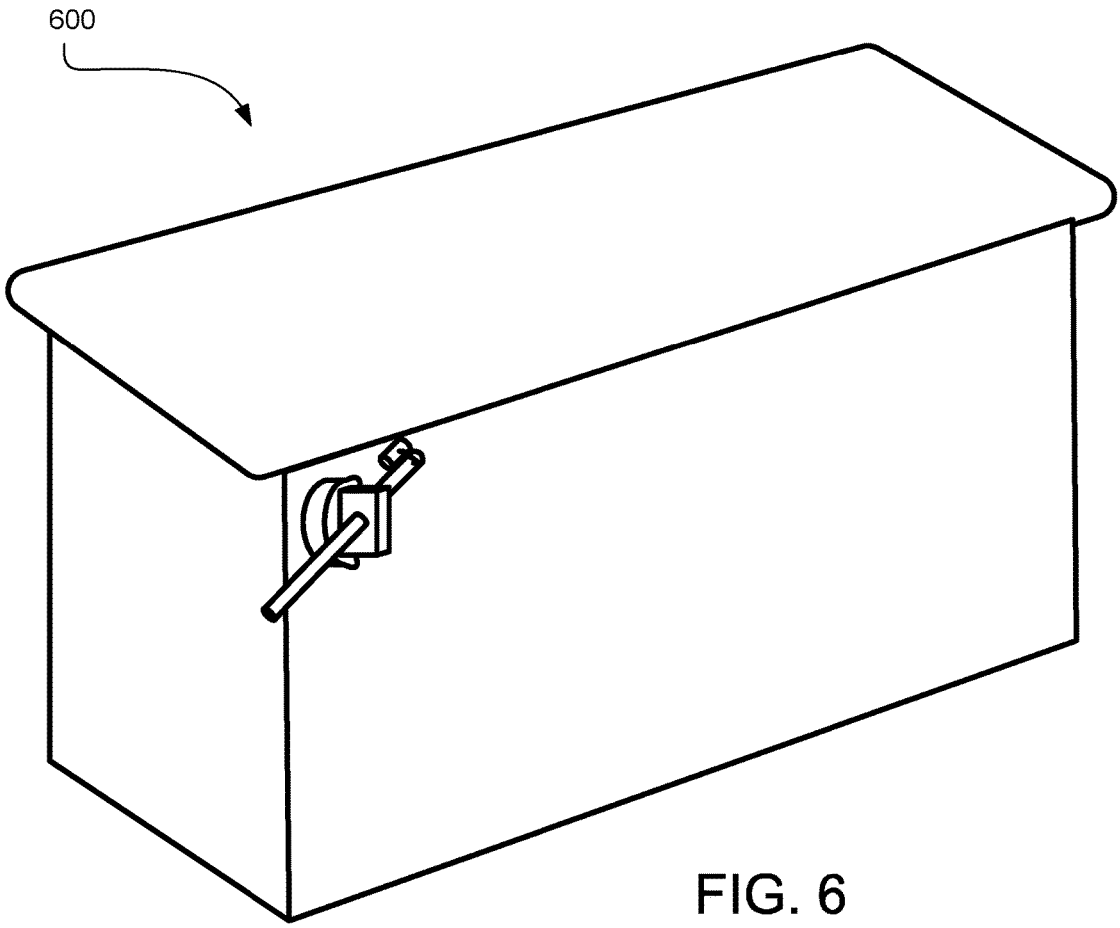
FIG. 6 depicts the rotatable toilet tank lever of FIG. 4 assembled onto a toilet tank.

FIG. 4 is an illustration 400 of an alternative embodiment of the limiting mechanism of the rotatable toilet tank lever. The upward movement of the controller 7 is limited by the stopper 402, which is connected to the controller 7 through a link 404. FIG. 5 is an illustration 500 of the rotatable toilet tank lever of FIG. 4 but in an disengaged state. The stopper 402 can move between the engaged position and the disengage position as shown by the arrow 502. When the stopper is in the disengaged position, the stopper 402 drops under the controller 7, thus not interfering with the upward movement of the controller 7. FIG. 6 is an illustration 600 of the rotatable toilet tank lever of FIG. 4 assembled onto a toilet tank.

When in use, the rotatable toilet tank lever of the present invention enables the user to reduce the amount of water flow into the toilet bowl by simply turning the push handle 6 counter clockwise, thus making the adjustment stick 8 pointed upwardly. By limiting the upward movement of the controller 7, the movement of the lifting arm 22 is also limited. Consequently, the flapper that is attached to a chain is lifted not to its high position. The rotatable toilet tank lever enables adjustment to different toilet tanks by rotating the adjustment stick 8. The adjustment stick 8 can also be used to fine tune the lifting position of the flapper. If the user desires to have more water flow into the toilet bowl, the user can simply turn the push handle 8 clockwise and moving the adjustment stick 8 away from the toilet tank 24, thus preventing the contact with the edge 26 of the toilet tank 24.

The present invented rotatable toilet tank lever equipped with the controller has one toilet tank lever at one side of a pivot and the controller at another side of the pivot. The function of the controller is to adjust delivery of the flushing water. When the controller is in use, the amount of the flushing water delivered is about half a gallon which is enough to flush liquid human wastes. When the function of the controller is not enable, the whole tank of water, about two and a half gallons, will be drained to flush the toilet. When the user pushes downward the handle of the toilet tank lever equipped with the controller, the tip of the controller will raise to hit the margin of the cover of toilet tank and a flapper inside the toilet tank will be lifted upwardly only about one inch to drain the water from the toilet tank to the toilet bowl to flush urine. After about half a gallon of water is drained into the toilet bowl and the user released the handle, the flapper drops to seal the opening of the drain pipe.

When user first rotates the toilet lever equipped with the controller 90 degree clockwise to turn the stopper from pointing upward direction to horizontal or even further down to point in a downward direction and then pushes toilet tank lever all the way down to lift flapper all the way up to float in toilet tank water to allow the whole tank of water, about two (2) gallons, drain into the toilet bowl to flush solid human waste. Ordinary people urinate several times a day and defecate only once a day. If the ordinary toilet tank lever is replaced with the rotatable toilet tank lever equipped with the controller a large amount of water can be saved to decrease water waste and to solve the shortage of water supply in big cities.

When the user turns the toilet tank lever equipped with the controller clockwise more than 90 degrees, the tip of the controller rotates toward the horizontal position or a more downward position to eliminate the effect of the controller and pushes the handle all the way down to lift up fully the flapper to float in the toilet tank thus opening the drain pipe completely to drain the whole tank of water, about two and half gallons of water, to flush solid human waste. Afterward the flapper will automatically drop down to seal the opening of the drain pipe to stop drainage of the water.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims. It is understood that features shown in different figures and described in different embodiments can be easily combined within the scope of the invention.

Modifications, additions, or omissions may be made to the systems and methods described without departing from the scope of the disclosure. The components of the systems and methods described may be integrated or separated according to particular needs. Moreover, the operations of the systems and methods described may be performed by more, fewer, or other components without departing from the scope of the present disclosure.

Although the present disclosure has been described with several embodiments, sundry changes, substitutions, variations, alterations, and modifications can be suggested to one skilled in the art, and it is intended that the disclosure encompass all such changes, substitutions, variations, alterations, and modifications falling within the spirit and scope of the appended claims.

The invention claimed is:

1. A rotatable toilet lever comprising:

a body;

a lifting arm attached to the body;

a pivot attached to the body;

a controller connected to the pivot;

a narrow threaded rod connected to the controller;

a push handle connected to the pivot; and a stopper movably connected to the controller;

wherein the pivot has a through hole through which the narrow threaded rod is inserted and the narrow threaded rod attaches to the push handle.

2. The rotatable toilet lever of claim 1, wherein the stopper is a threaded stick and moves up and down relative to the controller.

3. The rotatable toilet lever of claim 1, wherein the stopper is connected to the controller through a link and the stopper moves between a position above the controller and a position beneath the controller.

4. The rotatable toilet lever of claim 1, wherein when the rotatable toilet lever is assembled onto a toilet tank with a cover, upward movement of the controller is limited by the narrow threaded rod hitting the cover.

5. The rotatable toilet lever of claim 1, wherein the controller has a length and the length can be adjusted through one or more spacer rings.

6. The rotatable toilet lever of claim 1, wherein the push handle has a length and the length can be adjusted through one or more spacer rings.

7. The rotatable toilet lever of claim 1, further comprising a thumb screw attached to the push handle and the thumb screw enabling the push handle to rotate.

8. The rotatable toilet lever of claim 7, wherein the push handle further has a through hole, the thumb screw is inserted through the through hole to connect to a top pin.

9. The rotatable toilet lever of claim 1, wherein when the rotatable toilet lever is assembled onto a toilet tank with a cover, upward movement of the controller is limited by the stopper hitting the cover.

* * * * *